US010047763B2

(12) United States Patent
Anderson et al.

(10) Patent No.: US 10,047,763 B2
(45) Date of Patent: Aug. 14, 2018

(54) ROTOR ASSEMBLY FOR USE IN A TURBOFAN ENGINE AND METHOD OF ASSEMBLING

(71) Applicant: General Electric Company, Schenectady, NY (US)

(72) Inventors: Todd Alan Anderson, Niskayuna, NY (US); Nicholas Joseph Kray, Mason, OH (US); Bryant Edward Walker, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 444 days.

(21) Appl. No.: 14/968,306

(22) Filed: Dec. 14, 2015

(65) Prior Publication Data

US 2017/0167502 A1 Jun. 15, 2017

(51) Int. Cl.

| | |
|---|---|
| ***F04D 29/32*** | (2006.01) |
| ***F04D 29/64*** | (2006.01) |
| ***F01D 5/30*** | (2006.01) |

(52) U.S. Cl.

CPC ..... *F04D 29/322* (2013.01); *F01D 5/3023* (2013.01); *F04D 29/324* (2013.01); *F04D 29/644* (2013.01); *F05B 2220/302* (2013.01); *F05B 2230/60* (2013.01); *F05B 2260/30* (2013.01); *F05D 2220/36* (2013.01); *F05D 2260/31* (2013.01)

(58) Field of Classification Search

CPC .... F04D 29/322; F04D 29/644; F04D 29/324; F01D 5/3023; F05D 2220/36; F05D 2220/226; F05D 2220/31; F05B 2220/302; F05B 2260/30; F05B 2230/60

See application file for complete search history.

(56) References Cited

U.S. PATENT DOCUMENTS

| | | | | |
|---|---|---|---|---|
| 3,269,702 | A * | 8/1966 | Nichols | F01D 9/042 415/189 |
| 3,813,185 | A | 5/1974 | Bouiller et al. | |
| 4,451,959 | A * | 6/1984 | Miller | F01D 5/326 29/426.4 |

(Continued)

FOREIGN PATENT DOCUMENTS

| | | |
|---|---|---|
| EP | 1357295 A2 | 10/2003 |
| EP | 1396608 A2 | 3/2004 |

(Continued)

*Primary Examiner* — Woody Lee, Jr.
*Assistant Examiner* — Adam W Brown
(74) *Attorney, Agent, or Firm* — GE Global Patent Operation; Nitin Joshi

(57) ABSTRACT

A rotor assembly for use in a turbofan engine is provided. The rotor assembly includes an annular spool including a first blade opening defined therein, a first rotor blade configured to be radially inserted through the first blade opening, and a fairing positioned on a radially outer side of the annular spool. The first rotor blade includes a blade portion and a flange portion that extends substantially perpendicularly relative to the blade portion such that the flange portion is positioned on a radially inner side of the annular spool. The fairing is configured to receive a fastener radially inserted through the flange portion and the annular spool such that the first rotor blade is secured to the annular spool.

20 Claims, 4 Drawing Sheets

(56) References Cited

U.S. PATENT DOCUMENTS 4,500,255 A * 2/1985 Webb ..... F01D 5/225 415/189
4,832,568 A * 5/1989 Roth ..... F01D 9/042 415/189
5,263,823 A 11/1993 Cabaret et al.
5,272,869 A * 12/1993 Dawson ..... F01D 9/042 415/142
5,320,490 A * 6/1994 Corbin ..... F01D 9/042 415/209.2
5,378,110 A 1/1995 Ress, Jr.
5,494,404 A * 2/1996 Furseth ..... F01D 9/042 415/209.3
5,522,705 A * 6/1996 Elaini ..... F01D 5/225 416/190
5,632,600 A 5/1997 Hull
5,765,993 A * 6/1998 Weiss ..... B23P 6/005 29/889.1
5,855,709 A * 1/1999 Bocoviz ..... B29C 70/48 156/308.2
6,371,725 B1 * 4/2002 Manteiga ..... F01D 5/14 415/209.4
6,471,485 B1 10/2002 Rossmann et al.
6,582,186 B2 6/2003 Manzoori et al.
7,435,056 B2 10/2008 Liston
7,614,848 B2 * 11/2009 Bogue ..... B23P 6/005 29/888.022
7,780,420 B1 8/2010 Matheny
7,918,644 B2 4/2011 Schreiber
7,959,408 B2 * 6/2011 Belmonte ..... F01D 9/042 29/889.21
8,011,882 B2 9/2011 McMillan
8,075,280 B2 12/2011 Jones
8,177,513 B2 * 5/2012 Shim ..... B23P 15/04 29/889.7
8,282,355 B2 10/2012 Blanchard et al.
8,366,378 B2 2/2013 Beckford et al.
8,424,805 B2 4/2013 Smith
8,459,942 B2 * 6/2013 Sjunnesson ..... F01D 5/3023 415/191
8,734,101 B2 * 5/2014 McDonald ..... F01D 9/042 415/209.4
8,985,961 B2 3/2015 Chrzastek et al.
2011/0268561 A1 11/2011 Blanchard et al.
2013/0052004 A1 * 2/2013 Stilin ..... F01D 9/042 415/211.2
2013/0067930 A1 * 3/2013 Paradis ..... F01D 25/243 60/796
2013/0336794 A1 * 12/2013 Armstrong ..... F01D 9/00 416/189
2014/0013770 A1 * 1/2014 Farah ..... F01D 25/16 60/796

FOREIGN PATENT DOCUMENTS

EP 1681440 B1 8/2013
EP 1669543 B1 1/2014
EP 2142761 B1 3/2014

* cited by examiner

ROTOR ASSEMBLY FOR USE IN A TURBOFAN ENGINE AND METHOD OF ASSEMBLING

BACKGROUND

The present disclosure relates generally to turbofan engines and, more specifically, to systems and methods of retaining rotor blades engaged with an annular spool.

At least some known gas turbine engines, such as turbofan engines, include a fan, a core engine, and a power turbine. The core engine includes at least one compressor, a combustor, and a high-pressure turbine coupled together in a serial flow relationship. More specifically, the compressor and high-pressure turbine are coupled through a first drive shaft to form a high-pressure rotor assembly. Air entering the core engine is mixed with fuel and ignited to form a high energy gas stream. The high energy gas stream flows through the high-pressure turbine to rotatably drive the high-pressure turbine such that the shaft rotatably drives the compressor. The gas stream expands as it flows through a power or low-pressure turbine positioned aft of the high-pressure turbine. The low-pressure turbine includes a rotor assembly having a fan coupled to a second drive shaft. The low-pressure turbine rotatably drives the fan through the second drive shaft.

Many modern commercial turbofans include a low-pressure compressor, also referred to as a booster, positioned aft of the fan and coupled along the second drive shaft. The low-pressure compressor includes a booster spool and a plurality of rotor blades either formed integrally with or coupled to the booster spool with one or more retaining features. For example, the rotor blades may be individually inserted into and rotated circumferentially within a circumferential slot defined within the booster spool for positioning the rotor blades in a final seated position. However, as components of the turbine engine are increasingly being fabricated from lightweight materials, such as carbon fiber reinforced polymer (CFRP), more efficient and weight effective means for retaining rotor blades may be desired.

BRIEF DESCRIPTION

In one aspect, a rotor assembly for use in a turbofan engine is provided. The rotor assembly includes an annular spool including a first blade opening defined therein, a first rotor blade configured to be radially inserted through the first blade opening, and a fairing positioned on a radially outer side of the annular spool. The first rotor blade includes a blade portion and a flange portion that extends substantially perpendicularly relative to the blade portion such that the flange portion is positioned on a radially inner side of the annular spool. The fairing is configured to receive a fastener radially inserted through the flange portion and the annular spool such that the first rotor blade is secured to the annular spool.

In another aspect, a turbofan engine is provided. The turbofan engine includes a low-pressure compressor including an annular spool including a first blade opening defined therein, a first rotor blade configured to be radially inserted through the first blade opening, and a fairing positioned on a radially outer side of said annular spool. The first rotor blade includes a blade portion and a flange portion that extends substantially perpendicularly relative to the blade portion such that the flange portion is positioned on a radially inner side of the annular spool. The fairing is configured to receive a fastener radially inserted through the flange portion and the annular spool such that the first rotor blade is secured to the annular spool.

In yet another aspect, a method of assembling a rotor assembly for use in a turbofan engine is provided. The method includes defining a first blade opening within an annular spool, and inserting a first rotor blade through the first blade opening from a radially inner side of the annular spool. The first rotor blade includes a blade portion and a flange portion that extends substantially perpendicularly relative to the blade portion such that the flange portion is positioned on a radially inner side of the annular spool. The method also includes positioning a fairing on a radially outer side of the annular spool, and inserting a fastener through the flange portion, the annular spool, and into the fairing such that the first rotor blade is secured to the annular spool.

DRAWINGS

These and other features, aspects, and advantages of the present disclosure will become better understood when the following detailed description is read with reference to the accompanying drawings in which like characters represent like parts throughout the drawings, wherein.

Figure 1:
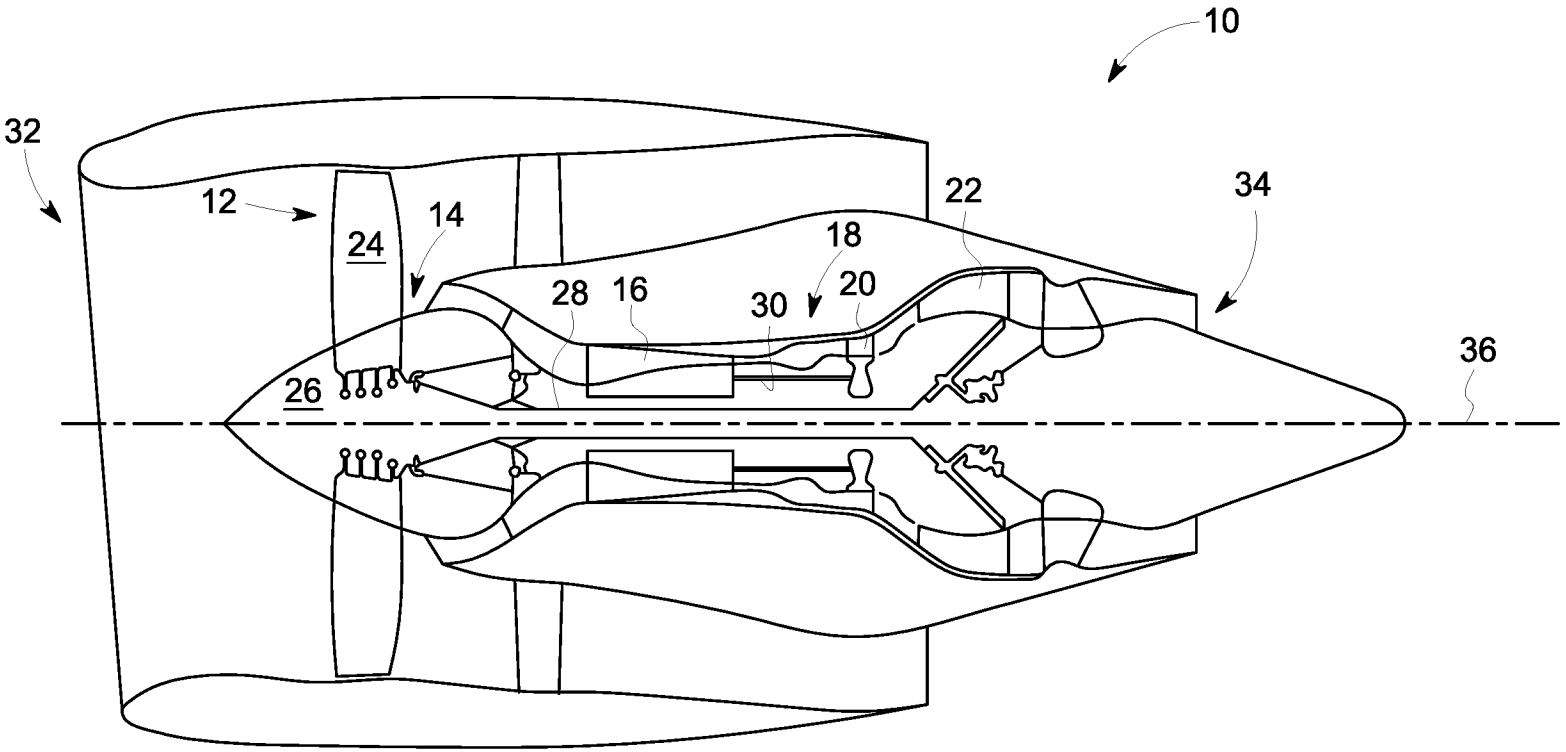
FIG. 1 is a schematic illustration of an exemplary turbofan engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Embodiments of the present disclosure relate to turbine engines, such as turbofans, and methods of manufacturing thereof. More specifically, the turbine engines described herein include an annular spool including a plurality of blade openings for receiving radially insertable rotor blades therethrough. The rotor blades include a flange portion positioned on a radially inner side of the annular spool for retaining the rotor blades within each blade opening. The rotor assembly also includes a fairing positioned on a radially outer side of the annular spool, and a fastener is radially inserted through the flange portion, the annular spool, and into the fairing to secure the rotor blade to the annular spool. As such, the attachment features described herein facilitate properly seating the rotor blades within the blade openings while also reducing the complexity of assembling the rotor assembly, and reducing the complexity of fabricating the rotor blades.

FIG. 1 is a schematic illustration of an exemplary turbofan engine 10 including a fan assembly 12, a low pressure or booster compressor 14, a high-pressure compressor 16, and a combustor assembly 18. Fan assembly 12, booster compressor 14, high-pressure compressor 16, and combustor assembly 18 are coupled in flow communication. Turbofan engine 10 also includes a high-pressure turbine 20 coupled in flow communication with combustor assembly 18 and a low-pressure turbine 22. Fan assembly 12 includes an array of fan blades 24 extending radially outward from a rotor disk 26. Low-pressure turbine 22 is coupled to fan assembly 12 and booster compressor 14 via a first drive shaft 28, and high-pressure turbine 20 is coupled to high-pressure compressor 16 via a second drive shaft 30. Turbofan engine 10 has an intake 32 and an exhaust 34. Turbofan engine 10 further includes a centerline 36 about which fan assembly 12, booster compressor 14, high-pressure compressor 16, and turbine assemblies 20 and 22 rotate.

In operation, air entering turbofan engine 10 through intake 32 is channeled through fan assembly 12 towards booster compressor 14. Compressed air is discharged from booster compressor 14 towards high-pressure compressor 16. Highly compressed air is channeled from high-pressure compressor 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbofan engine 10 via exhaust 34.

Figure 2:
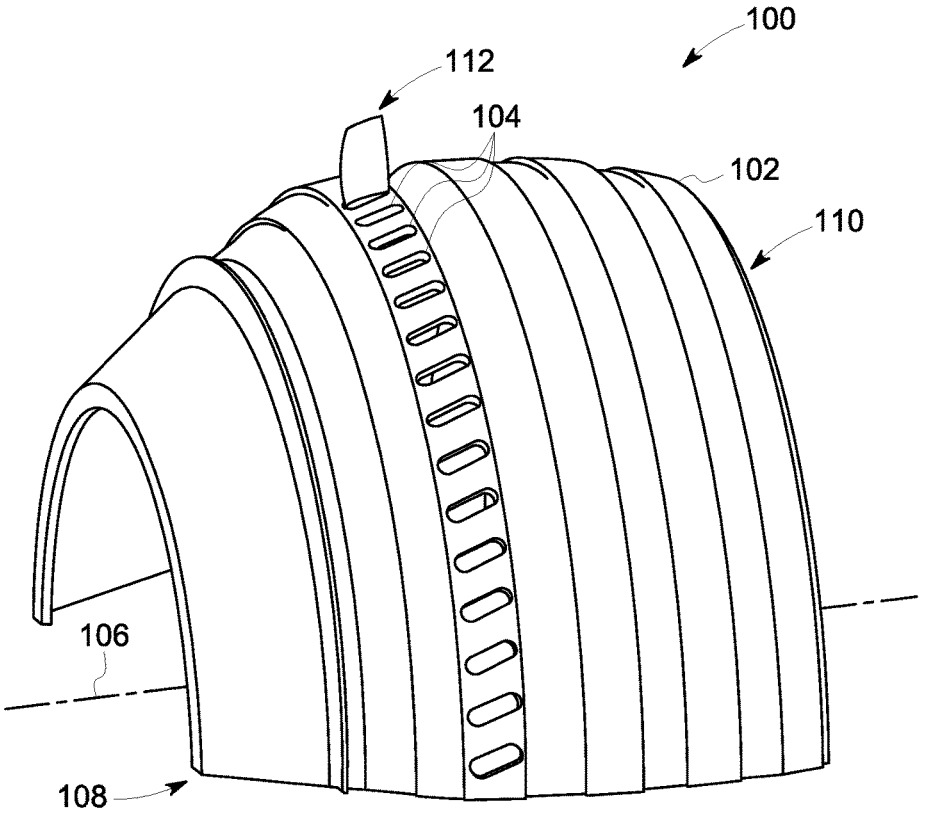
FIG. 2 is a partial perspective view of an exemplary rotor assembly that may be used in the turbofan engine shown in FIG. 1.

FIG. 2 is a partial perspective view of an exemplary rotor assembly 100 that may be used in turbofan engine 10 (shown in FIG. 1). In the exemplary embodiment, rotor assembly 100 includes an annular spool 102 including a plurality of blade openings 104 defined therein. More specifically, blade openings 104 are spaced circumferentially about a centerline 106 of annular spool 102. Annular spool 102 also includes a forward first end 108 and an aft second end 110 having a greater radial size than first end 108. In one embodiment, rotor assembly 100 is designed for use in booster compressor 14 (shown in FIG. 1). As such, when used in booster compressor 14, annular spool 102 is oriented such that first end 108 is located proximate fan assembly 12 and second end 110 is located proximate high-pressure compressor 16. Moreover, while shown as having a semi-circular shape, it should be understood that annular spool 102 may either be formed from a fully annular structure or formed from two or more arcuate sections coupled together to form the fully annular structure.

Rotor assembly 100 also includes at least one rotor blade 112 radially insertable through each blade opening 104. As will be described in more detail below, blade openings 104 are oversized relative to rotor blades 112. More specifically, in the exemplary embodiment, at least a portion of rotor blades 112 have a twisted profile, thereby causing the orientation of rotor blades 112 to be modified while being radially inserted through blade openings 104. As such, the asymmetric (i.e., cambered and twisted) shape of rotor blades 112 causes blade openings 104 to be oversized relative to rotor blades 112.

Figure 3:
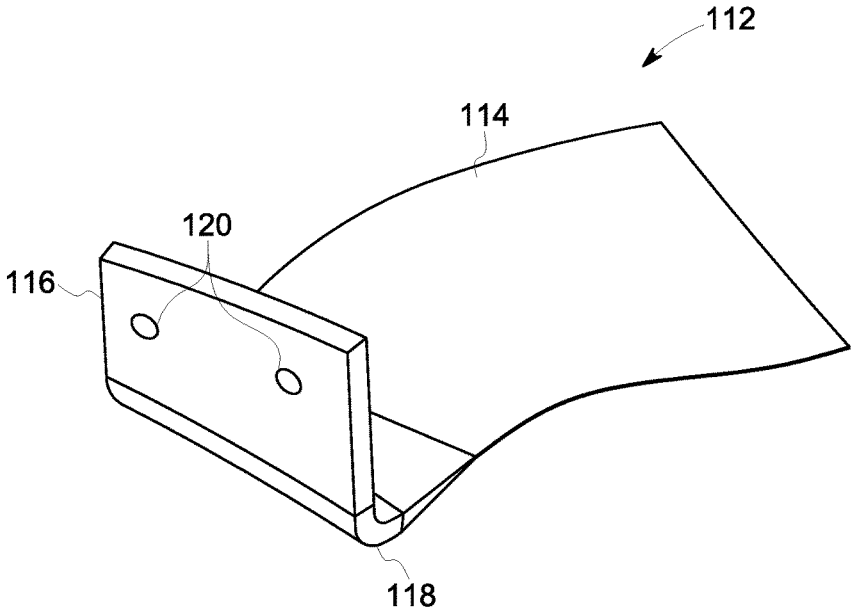
FIG. 3 is a perspective view of an exemplary rotor blade that may be used in the rotor assembly shown in FIG. 2.

FIG. 3 is a perspective view of an exemplary rotor blade 112 that may be used in rotor assembly 100 (shown in FIG. 2). In the exemplary embodiment, rotor blade 112 includes a blade portion 114, a flange portion 116 that extends substantially perpendicularly relative to blade portion 114, and a bent portion 118 extending between blade portion 114 and flange portion 116. As described above, blade portion 114 has a twisted and cambered profile. Moreover, flange portion 116 is embodied as a retaining feature for ensuring rotor blade 112 remains properly seated within blade openings 104 (shown in FIG. 2) during operation of rotor assembly 100. In the exemplary embodiment, flange portion 116 extends substantially perpendicularly relative to blade portion 114 and includes a pair of fastener openings 120 defined therein. As such, flange portion 116 restricts radial movement of rotor blade 112 within blade opening 104, and fastener openings 120 facilitate securing rotor blade 112 to annular spool 102 with a fastener (not shown in FIG. 3), as will be described in more detail below.

In the exemplary embodiment, rotor blades 112 are fabricated from a non-metallic material, such as a carbon fiber reinforced polymer (CFRP) material. More specifically, rotor blades 112 are fabricated from one or more plies of unidirectional or woven pre-impregnated composite material. Each of blade portion 114, flange portion 116, and bent portion 118 are constructed differently to account for different loads or stresses induced thereto during operation of turbofan engine 10 (shown in FIG. 1). For example, in one embodiment, blade portion 114 is fabricated from unidirectional or woven material, and has low crimp properties and a bias in the spanwise direction of rotor blade 112. Moreover, bent portion 118 is fabricated from a three-dimensional orthogonal woven material, and has a greater through thickness and interlaminar properties than blade portion 114 and flange portion 116. Finally, flange portion 116 is fabricated from a woven material having balanced in-plane properties to facilitate maintaining the position of rotor blade 112 when subjected to multiple thermal cycles, and with respect to attachment hardware. Moreover, flange portion 116 is fabricated with high through thickness properties around fastener openings 120. In an alternative embodiment, rotor blades 112 are fabricated from any material that enables rotor assembly 100 to function as described herein.

Figure 4:
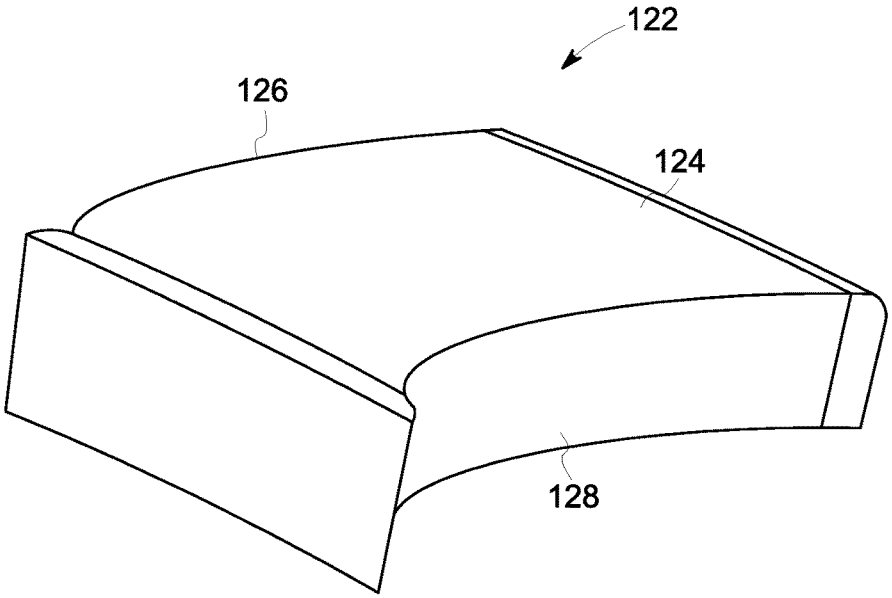
FIG. 4 is a perspective view of an exemplary fairing that may be used in the rotor assembly shown in FIG. 2.
Figure 5:
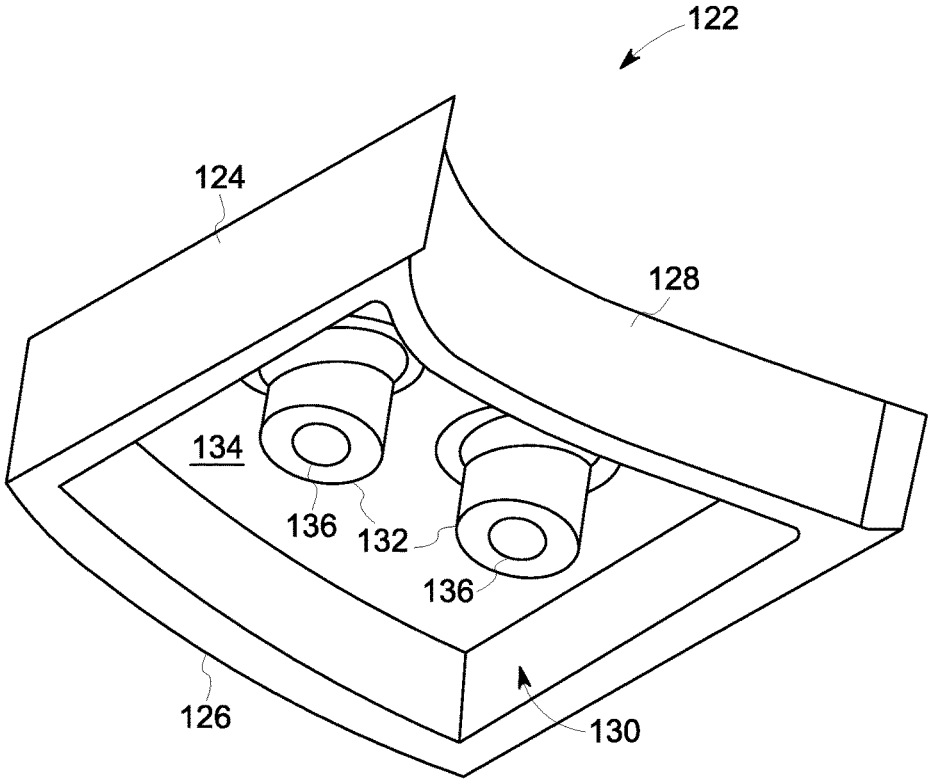
FIG. 5 is an alternative perspective view of the fairing shown in FIG. 4.

FIG. 4 is a perspective view of an exemplary fairing 122 that may be used in rotor assembly 100 (shown in FIG. 2), and FIG. 5 is an alternative perspective view of fairing 122. In the exemplary embodiment, fairing 122 includes an arcuate body 124 having a convex side edge 126 and a concave side edge 128. Arcuate body 124 is shaped substantially complementary with the contour of annular spool 102 (shown in FIG. 2). Moreover, when positioned between adjacent rotor blades 112, convex side edge 126 is contoured to mate with a first of the adjacent rotor blades, and concave side edge 128 is contoured to mate with a second of the adjacent rotor blades, as will be described in more detail below.

Referring to FIG. 5, fairing 122 also includes a recessed cavity 130 defined within arcuate body 124, which facilitates reducing the weight of fairing 122. A pair of fastener projections 132 extend from an inner surface 134 defined by recessed cavity 130, and each fastener projection 132 includes a threaded opening 136 defined therein. As will be described in more detail below, threaded openings 136 threadably engage the fastener (not shown in FIG. 5) to facilitates securing rotor blade 112 to annular spool 102 (each shown in FIG. 2).

Figure 6:
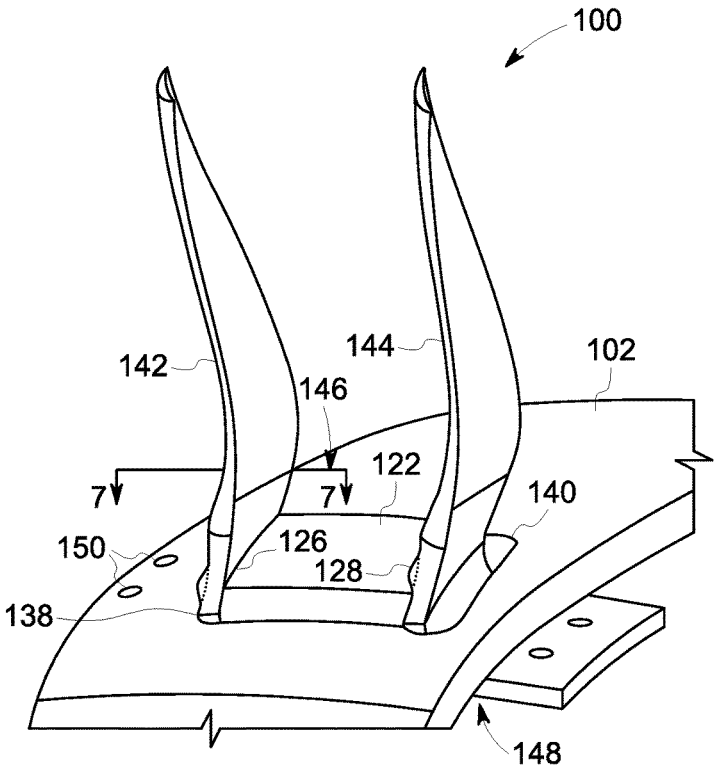
FIG. 6 is a partial cutaway view of a portion of the rotor assembly shown in FIG. 2.
Figure 7:
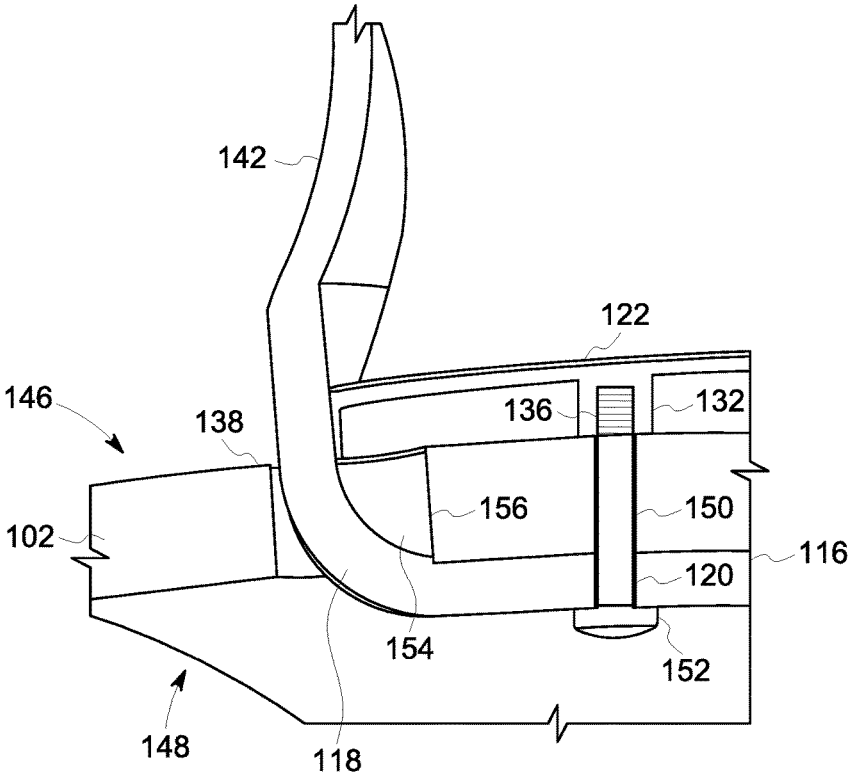
FIG. 7 is a cross-sectional view of the portion of the rotor assembly shown in FIG. 6, taken along Line 7-7.

FIG. 6 is a partial cutaway view of a portion of rotor assembly 100, and FIG. 7 is a cross-sectional view of the portion of rotor assembly 100, taken along Line 7-7 (shown in FIG. 6). In the exemplary embodiment, rotor assembly 100 includes a first blade opening 138 and a second blade opening 140 defined within annular spool 102. Second blade opening 140 is positioned adjacent first blade opening 138. A first rotor blade 142 is radially inserted through first blade opening 138, and a second rotor blade 144 is radially inserted through second blade opening 140. Rotor assembly 100 also includes fairing 122 positioned on a radially outer side 146 of annular spool 102, and sized to extend between first rotor blade 142 and second rotor blade 144. As described above, fairing 122 includes convex side edge 126 and concave side edge 128. When positioned between first rotor blade 142 and second rotor blade 144, concave side edge 128 mates with first rotor blade 142, and convex side edge 126 mates with second rotor blade 144. In some embodiments, a sealant is applied at an interface defined between convex and concave side edges 128 and 126 and respective rotor blades 142 and 144 to restrict leakage through first blade opening 138 and second blade opening 140, or from aft to fore relative to centerline 36 bypassing rotor blades 142 and 144. Moreover, fairing 122 is sized to extend between first rotor blade 142 and second rotor blade 144 to ensure a substantially continuous flow path is defined across annular spool 102. In an alternative embodiment, the sealant may be replaced by a gasket or an elastomeric insert.

Referring to FIG. 7, first rotor blade 142 is radially inserted through first blade opening 138, and flange portion 116 of first rotor blade 142 extends substantially perpendicular relative to blade portion 114 of first rotor blade 142 such that flange portion 116 is positioned on a radially inner side 148 of annular spool 102. More specifically, flange portion 116 is oriented to extend circumferentially along radially inner side 148 of annular spool 102. Moreover, annular spool 102 includes fastener openings 150 defined there that substantially align with fastener openings 120 in flange portion 116 and threaded openings 136 in fairing 122. A fastener 152 is then inserted through flange portion 116, annular spool 102, and into fairing 122 such that first rotor blade 142 is secured to annular spool 102.

In some embodiments, a radius filler 154 is positioned between bent portion 118 of first rotor blade 142 and a side wall 156 of first blade opening 138. Radius filler 154 is fabricated from any material that enables rotor assembly 100 to function as described herein. More specifically, the material used to fabricate radius filler 154 is thermal expansively compliant with the non-metallic material used to fabricate first rotor blade 142, and has an elastic modulus capable of constraining first rotor blade 142 within first blade opening 138 without bending. Exemplary materials used to fabricate radius filler 154 include, but are not limited to, a polymeric material, a thermoplastic material, or a composite material.

An exemplary technical effect of the system and methods described herein includes at least one of: (a) reducing the overall weight of a turbofan engine; (b) reducing the time and complexity required to assemble a rotor assembly including individual rotor blades; (c) enabling the incorporation of composite material within a booster compressor of a turbofan engine; (d) improving the damping characteristics of the assembly due to improved dissipation from the use of composite/polymer materials; and (e) reducing the complexity of the maintenance and service of individual rotor blades in the spool.

Exemplary embodiments of a turbofan engine and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only turbofan engines and related methods as described herein. Rather, the exemplary embodiment can be implemented and utilized in connection with many applications where easily assembling a rotor assembly is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A rotor assembly for use in a turbofan engine, said rotor assembly comprising:

an annular spool comprising a first blade opening defined therein;

a first rotor blade configured to be radially inserted through said first blade opening, said first rotor blade comprising a blade portion and a flange portion that extends substantially perpendicularly relative to said blade portion, said flange portion positioned on a radially inner side of said annular spool; and a fairing positioned on a radially outer side of said annular spool, wherein said fairing is configured to receive a fastener radially inserted through said flange portion and said annular spool such that said first rotor blade is secured to said annular spool.

2. The rotor assembly in accordance with claim 1 further comprising a second rotor blade configured to be radially inserted through a second blade opening defined in said annular spool, said second blade opening positioned adjacent said first blade opening, wherein said fairing is sized to extend between said first rotor blade and said second rotor blade.

3. The rotor assembly in accordance with claim 2, wherein said fairing comprises a convex side edge configured to mate with said first rotor blade, and a concave side edge configured to mate with said second rotor blade.

4. The rotor assembly in accordance with claim 1, wherein said fairing comprises a threaded opening defined therein, said threaded opening configured to threadably engage the fastener.

5. The rotor assembly in accordance with claim 1, wherein said flange portion is oriented to extend circumferentially along the radially inner side of said annular spool.

6. The rotor assembly in accordance with claim 1 further comprising a radius filler positioned between a bent portion of said first rotor blade and a side wall of said first blade opening.

7. The rotor assembly in accordance with claim 1, wherein said rotor blade is fabricated from a non-metallic material.

8. A turbofan engine comprising:

a low-pressure compressor comprising:

an annular spool comprising a first blade opening defined therein;

a first rotor blade configured to be radially inserted through said first blade opening, said first rotor blade comprising a blade portion and a flange portion that extends substantially perpendicularly relative to said blade portion, said flange portion positioned on a radially inner side of said annular spool; and a fairing positioned on a radially outer side of said annular spool, wherein said fairing is configured to receive a fastener radially inserted through said flange portion and said annular spool such that said first rotor blade is secured to said annular spool.

9. The turbofan engine in accordance with claim 8 further comprising a second rotor blade configured to be radially inserted through a second blade opening defined in said annular spool, said second blade opening positioned adjacent said first blade opening, wherein said fairing is sized to extend between said first rotor blade and said second rotor blade.

10. The turbofan engine in accordance with claim 9, wherein said fairing comprises a concave side edge configured to mate with said first rotor blade, and a convex side edge configured to mate with said second rotor blade.

11. The turbofan engine in accordance with claim 8, wherein said fairing comprises a threaded opening defined therein, said threaded opening configured to threadably engage the fastener.

12. The turbofan engine in accordance with claim 8, wherein said flange portion is oriented to extend circumferentially along the radially inner side of said annular spool.

13. The turbofan engine in accordance with claim 8 further comprising a radius filler positioned between a bent portion of said first rotor blade and a side wall of said first blade opening.

14. The turbofan engine in accordance with claim 8, wherein said rotor blade is fabricated from a non-metallic material.

15. A method of assembling a rotor assembly for use in a turbofan engine, said method comprising:

defining a first blade opening within an annular spool;

inserting a first rotor blade through the first blade opening from a radially inner side of the annular spool, wherein the first rotor blade includes a blade portion and a flange portion that extends substantially perpendicularly relative to the blade portion such that the flange portion is positioned on a radially inner side of the annular spool;

positioning a fairing on a radially outer side of the annular spool; and inserting a fastener through the flange portion, the annular spool, and into the fairing such that the first rotor blade is secured to the annular spool.

16. The method in accordance with claim 15 further comprising:

defining a threaded opening in the fairing;

defining a first fastener opening in the annular spool;

defining a second fastener opening in the flange portion of the first rotor blade; and aligning the threaded opening, the first fastener opening, and the second fastener opening prior to inserting the fastener.

17. The method in accordance with claim 16, wherein inserting a fastener comprises threadably engaging the fastener with the threaded opening in the fairing.

18. The method in accordance with claim 15 further comprising:

defining a second blade opening within the annular spool;

inserting a second rotor blade through the second blade opening from the radially inner side of the annular spool; and extending the fairing between the first rotor blade and the second rotor blade.

19. The method in accordance with claim 15, wherein inserting a first rotor blade comprises orienting the flange portion of the first rotor blade to extend circumferentially along the radially inner side of the annular spool.

20. The method in accordance with claim 15 further comprising positioning a radius filler between a bent portion of the first rotor blade and a side wall of the first blade opening.

* * * * *